United States Patent [19]

Schafer

[11] 4,215,803

[45] Aug. 5, 1980

[54] ICE HOPPER HAVING A PLURALITY OF SHELVES AND A RAMP

[75] Inventor: Albert L. Schafer, Chicago, Ill.

[73] Assignee: Remcor Products Company, Franklin Park, Ill.

[21] Appl. No.: 928,243

[22] Filed: Jul. 26, 1978

[51] Int. Cl.[2] ..... B67D 5/64

[52] U.S. Cl. ..... 222/240; 222/328; 222/564; 366/307

[58] Field of Search ..... 222/146 R, 146 C, 227, 222/239, 240, 241, 242, 328, 460, 547, 185, 564; 366/302, 305, 306, 307; 62/344; 198/642

[56] References Cited

U.S. PATENT DOCUMENTS

| | | | |
|---|---|---|---|
| Re. 22,437 | 2/1944 | Sinden | 222/240 |
| 895,489 | 8/1908 | Morse | 222/239 |
| 1,730,784 | 10/1929 | Rogginger | 222/227 |
| 1,859,290 | 5/1932 | Davis | 222/227 X |
| 2,779,752 | 1/1957 | Vining | 366/307 X |
| 3,101,872 | 8/1963 | Dickinson | 222/227 X |
| 3,211,338 | 10/1965 | Weil et al. | 222/146 C X |
| 3,393,839 | 7/1968 | Weil et al. | 222/239 |
| 3,517,860 | 6/1970 | Whalen | 222/202 |

*Primary Examiner*—David A. Scherbel
*Assistant Examiner*—Fred A. Silverberg
*Attorney, Agent, or Firm*—Gary, Juettner & Pyle

[57] ABSTRACT

An ice handling apparatus effectively handles crushed, cracked, flaked or cubed ice without agglomeration or congealing of the ice. The apparatus has a hopper for holding a mass of small particles of ice and an agitator in the hopper, and in one embodiment the hopper has level or inclined shelves extending from its side walls for supporting the ice and decreasing the compressive pressures to which the mass of ice is subjected, and for cooperating with the agitator to keep the ice particles in discrete, free flowing form. The hopper has an opening spaced above a lowermost end thereof through which ice may be dispensed, and in accordance with another embodiment of the invention a ramp extends from the bottom of the hopper to the opening to smoothly carry ice to the opening and facilitate dispensing of ice from the hopper. In combination with the shelves, the ramp provides for significantly improved dispensing of discrete, free flowing particles of ice.

12 Claims, 4 Drawing Figures

ICE HOPPER HAVING A PLURALITY OF SHELVES AND A RAMP

BACKGROUND OF THE INVENTION

The invention relates to ice handling apparatus, and in particular to an improved ice handling apparatus which minimizes agglomeration and congealing and facilitates dispensing of particles of ice maintained in a storage bin.

When small particles of ice, such as ice in crushed, cracked, flaked or cubed form, are stored in bulk in a hopper, they tend to congeal into a solid mass and it becomes difficult if not impossible to dispense the same automatically and in an essentially free flowing condition. Moreover the ice, especially softer ices such as flake ice, may agglomerate to such an extent that cavitation will take place within the interior of the mass, leaving a lower dispensing area of the hopper devoid of ice even though the hopper is otherwise full.

Much effort has heretofore been expended to provide various kinds of knives and blades in a hopper for particulate ice to prevent the ice from congealing or agglomerating, whereby to break up the ice into discrete particles, render the same free flowing and maintain an adequate quantity of free flowing ice particles in the dispensing area. In one type of dispenser a rotating cutter equipped with knives or blades is supposed to slash its way through a stationary mass of small particles of ice so as to maintain them in discrete form. In another the ice is rotated as a mass in a circular hopper and the hopper is equipped with vertical and radial knives or blades to slash through the rotating mass. In U.S. Pat. No. 3,393,839, the latter type of device has been equipped with stationary blades of such character as to impart undulating or tremor-like movements to the ice both vertically and radially to maintain the ice as individual, free flowing particles.

Unfortunately, despite the abundance of various forms of knives and other chopping devices, the art has not yet provided a satisfactory solution to the congealing of ice in storage hoppers. In consequence of the weight of a relatively large mass of ice stored in a hopper, which may be on the order of fifty pounds or more, particles of ice in the lower portions of the hopper are often compacted by the overlying ice into a relatively solid mass which resists separation. Such agglomeration of ice particles greatly increases the problem of dispensing the ice, let alone dispensing the same in the form of discrete, free flowing particles.

In addition to agglomeration of ice within the hopper, a further problem to dispensing results from the particular positioning of the discharge opening in the hopper. In order to prevent melt water from being dispensed with ice, the bottom of the hopper usually has drain holes therein, and the dispensing opening is elevated slightly above the bottom. In consequence, a ridge is formed between the bottom of the hopper and the bottom of the dispensing opening over which ice must be moved during dispensing. The ridge significantly impedes dispensing of even free flowing particles of ice, and occasionally makes impossible dispensing of somewhat congealed lumps of ice.

OBJECT OF THE INVENTION

An object of the present invention is to provide an improved ice handling apparatus having an ice storage hopper with shelves extending inwardly from side wall areas thereof for aiding in supporting a mass of ice in the hopper and for cooperating with an agitator, all in a manner to prevent congealing and agglomeration of the ice particles and to maintain the same in discrete, free flowing form.

Another object of the invention is to provide an improved ice handling apparatus having an ice storage hopper with a ramp extending from a bottom surface thereof to a discharge opening therein for smoothly conveying ice in the hopper to the opening to facilitate discharge of ice from the hopper.

SUMMARY OF THE INVENTION

In accordance with the present invention, an ice handling apparatus includes a hopper for reception of a mass of small particles of ice, and an impeller rotatable in the hopper for agitating the ice. In one embodiment of the invention, to aid in preventing congealing and agglomeration of the particles of ice one or more shelves extend inwardly from side walls of the hopper for supporting ice thereon. The shelves support a portion of the weight of the ice and decrease the compressive forces to which underlying ice particles are subjected by overlying particles, thereby minimizing agglomeration and congealing of the ice, and cooperate with the impeller in maintaining the ice particles in discrete, free flowing form.

The hopper has a dispensing opening in proximity with but spaced above a lowermost wall of the hopper, whereby ice may be discharged from the hopper yet melt water precluded from passing through the opening. In accordance with another embodiment of the invention, a ramp extends from the bottom of the hopper up to the lower side of the discharge opening, so that ice may be smoothly carried from the bottom of the hopper and through the opening, whereby the discharge rate of ice from the hopper is significantly improved, with even congealed masses of ice being readily moved through the opening. Preferably, the ramp is formed integrally with the hopper.

Other objects, advantages and features of the invention will become apparent upon a consideration of the following detailed description, when taken in conjunction with the accompanying drawings.

DETAILED DESCRIPTION

Figure 1:
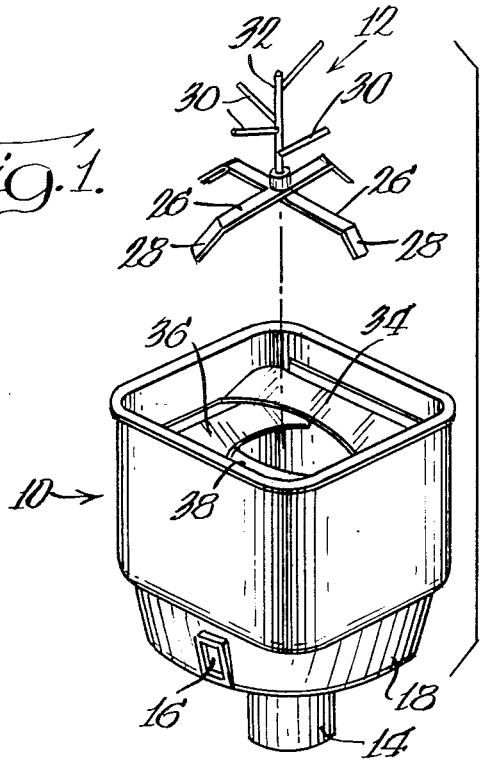
FIG. 1 is an exploded perspective view of a preferred embodiment of the apparatus of the invention.
Figure 2:
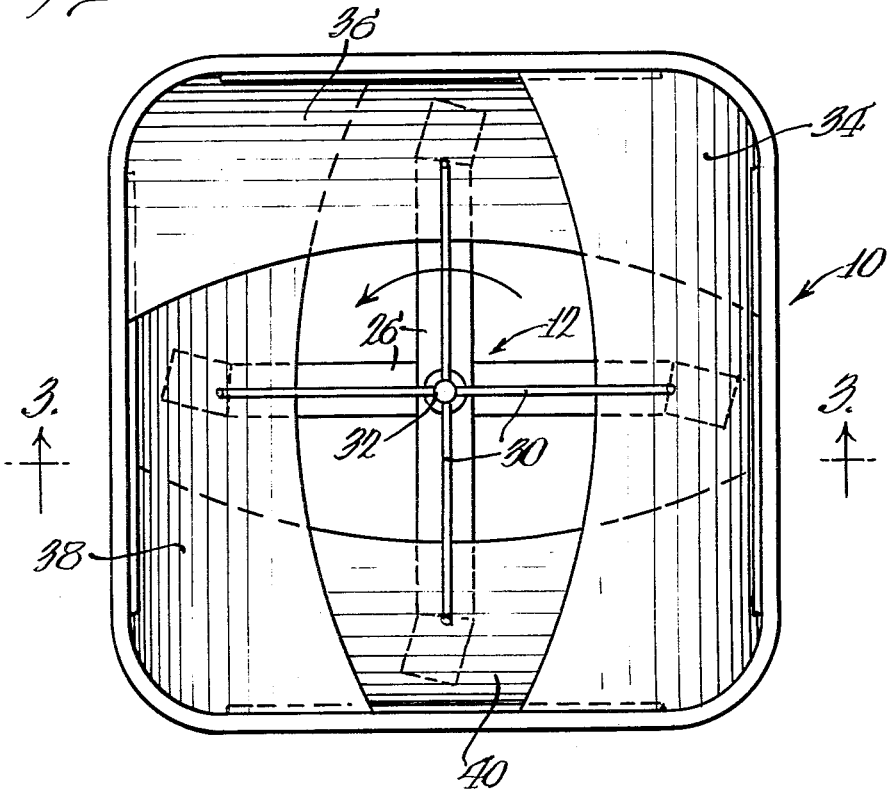
FIG. 2 is a plan view of the hopper of the apparatus, particularly illustrating an arrangement of shelves therein in accordance with one embodiment of the invention.

Referring to the drawings, an ice handling apparatus is conventionally comprised of a hopper, bin or tank, indicated generally at 10, for storing a large quantity of crushed, cracked, flake or cubed ice, such as fifty pounds, a rotary impeller indicated at 12 and driven by an electric motor 14, and a discharge opening 16 in a lower wall area of the hopper for accommodating discharge of ice from the lower end portion of the hopper.

Although no means is shown in connection with the hopper opening 16 for providing a controlled discharge of ice therethrough, since such does not form a part of and is not relevant to the principles of the present invention, it is understood that in a conventional use of the dispenser some means would be provided thereat for discharging ice from the hopper in a controlled manner. The means may take the form of any of the dispensing means shown in U.S. Pat. Nos. 3,165,901; 3,211,338 and 3,217,509, or of any other suitable means. A preferred dispensing means, however, is illustrated and disclosed in U.S. Pat. No. 3,211,338, to which reference is made for a more detailed description.

The hopper 10 is essentially an open top tub or bin the major part of which comprises a main upper portion of noncircular, preferably polygonal cross section, such as the square section shown. Although in the practice of the invention the upper portion of the hopper may be of circular or any other desired cross section, a polygonal cross section is preferred since when ice is rotated in such a hopper the side walls of the hopper, inasmuch as they undulate inwardly and outwardly relative to the axis of rotation of the mass of ice, alternately squeeze and release the mass, thereby imparting tremor-like movements to the mass, both radially and vertically, to help maintain the ice in the form of discrete particles. The illustrated hopper is like that disclosed in U.S. Pat. No. 3,517,860, to which reference is made for a more detailed description.

The bottom of the hopper is provided with a circular depression comprising an annular trough 18 with which the discharge opening 16 communicates. The opening 16 is spaced a short distance above the bottom of the trough to prevent passage of melt water therethrough, and the trough is appropriately provided at its bottom with drain holes 20, so that only discrete particles of relatively dry ice will be discharged through the opening 16. The bottom of the hopper is closed by an end wall 22 spaced above the trough, so that ice to be discharged will graviate into and be confined within the trough.

The hopper may be made in any conventional manner, such as by deep drawing of sheet material or the molding of plastics, and when completed is sheathed in insulation and provided with a removable insulated cover, all as is well known in the art.

The bottom wall 22 of the hopper is centrally apertured for upward, liquid sealed passage therethrough of a shaft 24 of the drive motor 14, which is suitably mounted on the wall 22 exteriorly of the hopper. Mounted on the shaft 24 within the interior of the hopper is the impeller 12 which has a plurality of radial arms 26 that generally follow the contour of the circular part of the bottom wall of the hopper, downwardly depending extensions 28 at ends of the arms that extend into the trough, and rods 30 which extend outwardly from an upstanding center post 32 of the impeller, all of which serve to engage within the mass of ice placed in the hopper to cause agitation thereof upon rotation of the impeller. To aid in discharge of ice from the hopper, the extensions 28 are provided with a pitch to urge the particles of ice in the trough through the discharge opening 16 when the impeller is rotated in a counterclockwise direction as viewed from above.

Although rotation of the impeller tends to break up the ice, and along with the polygonal configuration of the hopper walls maintains the ice particles in somewhat discrete, free flowing form, in accordance with one embodiment of the invention which significantly enhances a discrete and free flowing form of the particles, one or more shelves are mounted on the hopper side walls and extend in vertically staggered relationship inwardly of the hopper. For the embodiment shown and disclosed four shelves are on the hopper side walls, a first one 34 of which is uppermost in the hopper and extends along one of the side walls and between the two adjacent side walls. The next shelf 36 extends generally perpendicular to and below the shelf 34 along an adjacent side wall, and the third shelf 38 extends along the wall opposite from the shelf 34 vertically beneath and generally perpendicular to the shelf 36. The last shelf 40 is attached to the remaining side wall, and is the lowermost of the shelves. Each of the shelves has a generally curved inner edge which extends less than halfway through the hopper, whereby a vertically open section is defined in the hopper between the inner ends of the sleeves in which the upstanding center portion 32 of the impeller is received.

The shelves may be either inclined to or extend perpendicularly from the side walls of the hopper, and the arrangement of the impeller and the shelves preferably is such that individual outwardly extending rods 30 on the impeller are each arranged to pass parallel to and across an upper surface of an associated one of the shelves upon rotation of the impeller.

In use of the ice handling apparatus, with a mass of particles of ice in the hopper the shelves extend into the mass and support on their upper surfaces the overlying particles. In this manner, the maximum "head" of ice is decreased, and the particles of ice in the lower portion of the hopper are therefore subjected to decreased compressive forces, so that the same are not tightly packed together and agglomeration and congealing thereof is minimized. In further minimizing congealing of the ice, as the rods 30 move the mass of ice upon rotation of the impeller, the stationary shelves impart shear forces to the particles of ice to further aid in separating the same. It is to be appreciated that by virtue of the shelves being vertically staggered as they extend around the hopper, as ice is discharged from the hopper through the opening 16 and the overall mass of ice in the hopper moves downward, upon rotation of the impeller particles of ice gravitate downward from one shelf to the next, whereby a continuous supply of discrete particles of ice is maintained in the area of the discharge opening 16. In use of the dispenser with shelves, significant improvements have been observed in maintaining the particles of ice is discrete and free flowing form.

Although the hopper is shown with four shelves, any number of shelves may be used, the actual number depending primarily on the overall size and height of the hopper. For instance, with a somewhat smaller hopper two shelves could be used, which in the case of a polygonal shaped hopper would be positioned opposite from one another. Also, the shelves may advantageously be used in a hopper of any other cross sectional configuration, for example a circular or oval shaped hopper. In addition, although the shelves are shown as being successively positioned in 90° increments around the hopper, which for the four sided polygonal shaped hopper shown is most convenient, for other configurations of hoppers the shelves could be positioned in any desired increments, it being apparent and understood that the number of shelves and their positioning is dictated primarily by the overall size and configuration of the hopper in which they are mounted.

In accordance with another embodiment of the invention which facilitates discharge of ice through the opening 16 upon rotation of the impeller 12, the bottom of the hopper trough 18 is provided with a ramp 42 adjacent the opening. The ramp extends smoothly from the bottom of the trough to a height even with the lower edge of the discharge opening 16, and then returns smoothly back down to the bottom of the trough. As compared with conventional hoppers in which a lip is formed from the bottom of the trough to the discharge opening in order to prevent passage through the opening of melt water in the trough, the ramp 42 both provides a barrier to passage of melt water through the opening and forms a smooth and natural gravity path for movement of ice to the opening, whereby ice may be dispensed at rates far exceeding previous methods. In addition, by virtue of the smooth transition path for ice from the bottom of the trough to the discharge opening, less breakdown and fracturing of the ice occurs during dispensing which greatly increases both dispensing efficiency and the quality of ice dispensed. The ramp may be separate from and mounted to the bottom wall of the hopper, but for greatest economy and convenience is preferably formed integrally with and forms a part of the hopper.

Figure 3:
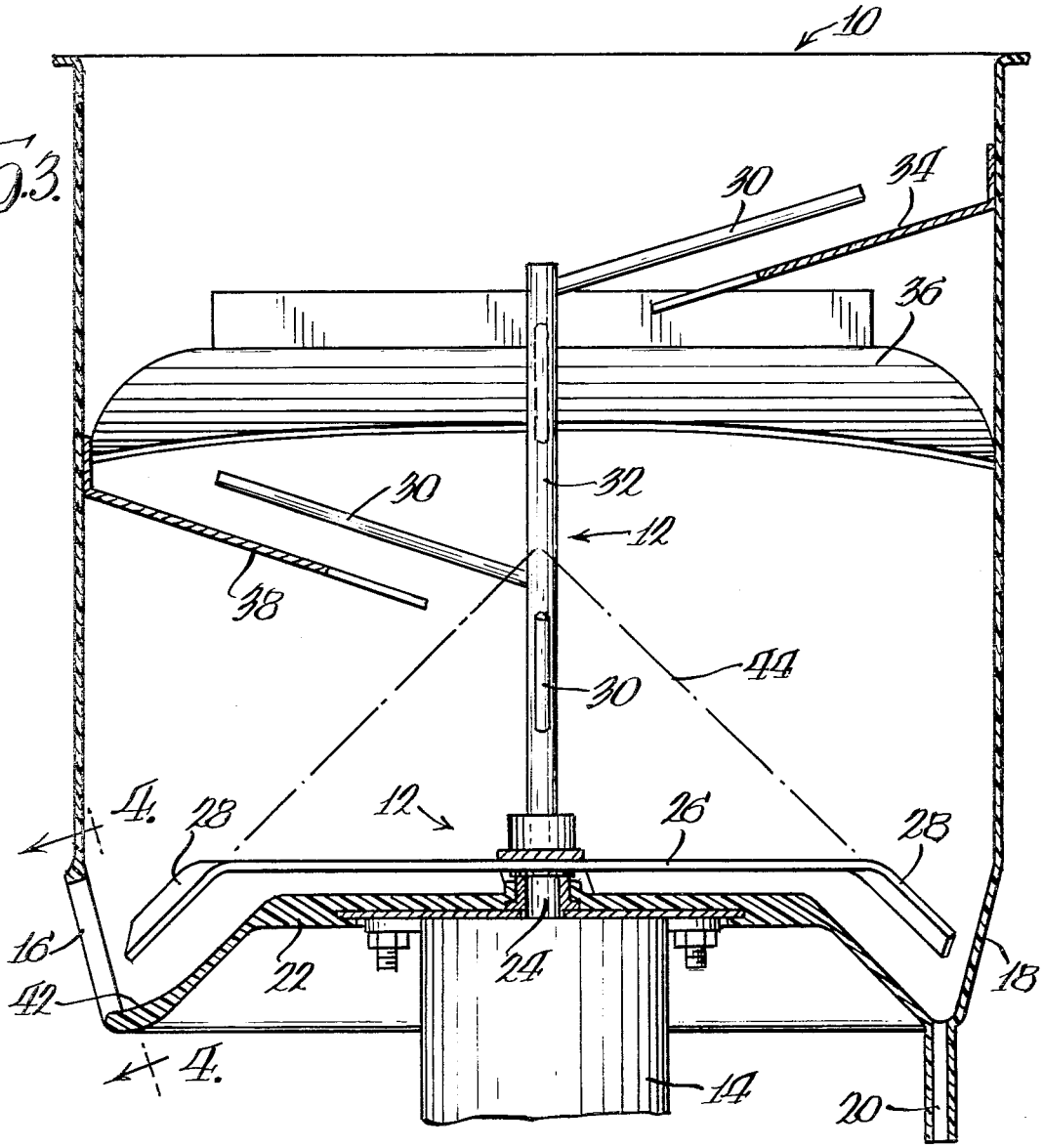
FIG. 3 is a vertical section view taken substantially along the line 3—3 of FIG. 2, and shows an arrangement of the shelves in the hopper as well as a ramp in the hopper at an ice discharge opening therefrom in accordance with another embodiment of the invention.
Figure 4:
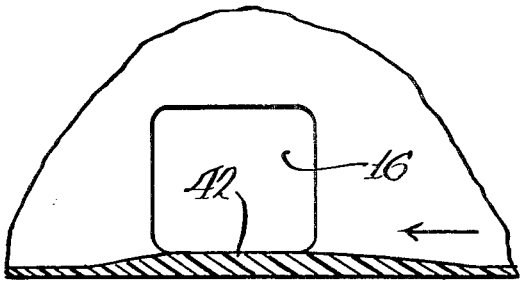
FIG. 4 is taken substantially along the line 4—4 of FIG. 3, and particularly illustrates the ramp in the hopper.

The arrangement of the hopper, agitator and shelves as shown finds primary advantage in the dispensing of crushed, cracked or cubed ice. Flaked ice, however, presents special problems, since due to its fine consistency smooth and uniform movement thereof across the shelves and downward through the hopper to the trough 18 for discharge from the opening 16 is somewhat difficult to accomplish. To this end, in order to facilitate movement of flake ice into the trough, a conical surface 44, shown in phantom lines in FIG. 3, may be provided on the impeller or agitator 12 to form a natural gravity path for the ice as it passes downward through the hopper to the trough. For this purpose, the surface 44 may either be formed with passages therethrough through which the impeller rods 30 extend from the center post 32, or it may form an integral portion of the impeller such that the rods 30 are attached only to the outer surface thereof.

While embodiments of the invention have been described in detail, various modifications and other embodiments thereof may be devised by one skilled in the art without departing from the spirit and scope of the invention, as defined in the appended claims.

What is claimed is:

1. An ice handling apparatus, comprising a hopper for reception of a mass of small particles of ice; an impeller rotatable in said hopper for agitating the ice within said hopper; and a plurality of shelves positioned at successive rotational increments and decreasing vertical positions within said hopper on side walls thereof, each said shelf extending adjacent to said side walls along a horizontal line and extending outwardly from said side walls to less than the center of said hopper for supporting at least a portion of the mass of ice thereon, whereby the pressure of ice overlying said shelves on ice underlying said shelves and congealing or agglomeration of the underlying ice are decreased, said impeller having an axis of rotation extending between inner ends of said shelves and a plurality of ice engaging arms extending outwardly from said axis at vertically staggered positions for rotation across upper surfaces of said shelves, rotation of said impeller moving ice horizontally in said hopper and across said shelves without forcing the ice downwardly so that as the ice moves off of each of said shelf the ice is free to gravitate onto the next succeeding shelf.

2. An ice handling apparatus as set forth in claim 1, said shelves each extending in a horizontal plane inwardly from said hopper side walls.

3. An ice handling apparatus as set forth in claim 1, said shelves each extending inwardly from said hopper side walls in a downwardly inclined plane.

4. An ice handling apparatus as set forth in claim 1, said hopper having an ice discharge opening through a side wall thereof in proximity with but spaced above a lower surface of said hopper, and including a ramp in said hopper extending along said lower surface and adjacent said side wall at said opening from said lower surface to adjacent the lower end of said opening for providing a smooth path for ice from said lower surface to said opening.

5. An ice handling apparatus, comprising a hopper for reception of a mass of small particles of ice and having an ice discharge opening through a side wall in a lower portion thereof; an impeller rotatable in said hopper for agitating the ice in said hopper; and a plurality of shelves positioned at successive rotational increments and decreasing vertical positions around side walls of said hopper, each said shelf extending adjacent to said side walls along a horizontal line and except for the lowermost shelf overlying at least a portion of the succeeding underlying shelf, whereby said shelves form a stepped ramp around said hopper from the uppermost to the lowermost shelf, said impeller having a plurality of ice engaging arms rotatable across upper surfaces of said shelves in the downward direction of the stepped ramp formed thereby, whereby with a mass of ice in said hopper said shelves support at least a portion of the mass to decrease the pressure of ice overlying said shelves on ice underlying said shelves in order to minimize congealing and agglomeration of the mass of ice, said impeller upon rotation urging ice horizontally, but not downwardly in said hopper and along said shelves for gravitation down the ramp formed by said shelves and to said ice discharge opening in said lower portion of said hopper.

6. An ice handling apparatus as set forth in claim 5, said shelves each extending less than half way across said hopper, said impeller having an axis of rotation extending between inner ends of said shelves.

7. An ice handling apparatus as in claim 5, said shelves each extending in a horizontal plane inwardly from said hopper side walls.

8. An ice handling apparatus as in claim 5, said shelves each extending inwardly from said hopper side walls toward the center of said hopper in a downwardly inclined plane.

9. An ice handling apparatus as in claim 5, said ice discharge opening being spaced above a lower surface of said hopper, and including a ramp in said hopper extending along said lower surface and adjacent said side wall at said opening between said lower surface and the lower end of said opening for providing a path for smooth movement of ice from said lower surface to said opening.

10. An ice handling apparatus, comprising a hopper for reception of a mass of small particles of ice therein, said hopper having a side wall extending upwardly from a lower surface of said hopper and having an ice discharge opening formed through said side wall thereof in proximity with but spaced from said lower surface; an impeller rotatable in said hopper for agitating the mass of ice therein and for moving the ice along said lower surface of said hopper and through said opening; and a ramp in said hopper extending along said lower surface, adjacent said side wall and between said lower surface and a lower end of said discharge opening substantially in the direction of rotation of the impeller for providing a smooth path for movement of ice from said lower surface to said opening, whereby the efficiency of discharge of ice from said hopper is increased.

11. An ice dispenser as in claim 10, wherein said ramp is integrally formed with said hopper.

12. An ice dispenser as in claim 10, said ramp extending smoothly to said lower surface from both sides of said opening.

* * * * *